US008087449B2

(12) United States Patent
Benedetti et al.

(10) Patent No.: US 8,087,449 B2
(45) Date of Patent: Jan. 3, 2012

(54) METHOD AND PLANT FOR THE PRODUCTION OF FLAT ROLLED PRODUCTS

(75) Inventors: Gianpietro Benedetti, Tricesimo (IT); Paolo Bobig, San Canzian d'Isonzo (IT)

(73) Assignee: Danieli & C. Officine Meccaniche SpA, Buttrio (UD) (IT)

( * ) Notice: Subject to any disclaimer, the term of this patent is extended or adjusted under 35 U.S.C. 154(b) by 0 days.

(21) Appl. No.: 12/791,094

(22) Filed: Jun. 1, 2010

(65) Prior Publication Data

US 2011/0272116 A1 Nov. 10, 2011

(30) Foreign Application Priority Data

May 10, 2010 (IT) ..... UD2010A0091

(51) Int. Cl.

| | |
|---|---|
| ***B22D 11/12*** | (2006.01) |
| ***B22D 11/14*** | (2006.01) |
| ***B22D 27/04*** | (2006.01) |
| ***B21B 1/46*** | (2006.01) |

(52) U.S. Cl. ..... 164/476; 164/477; 164/417; 164/493; 164/507; 29/527.7

(58) Field of Classification Search ..... 164/476, 164/477, 417, 424, 462, 493, 507; 29/527.7
See application file for complete search history.

(56) References Cited

U.S. PATENT DOCUMENTS

| | | | | |
|---|---|---|---|---|
| 5,219,114 | A * | 6/1993 | Kajiwara et al. | 228/158 |
| 5,307,864 | A * | 5/1994 | Arvedi et al. | 164/476 |
| 5,634,257 | A * | 6/1997 | Kajiwara et al. | 29/527.7 |
| 5,634,510 | A * | 6/1997 | Hirano et al. | 164/417 |
| 5,636,543 | A * | 6/1997 | Kajiwara et al. | 72/234 |

FOREIGN PATENT DOCUMENTS

| | | |
|---|---|---|
| DE | 19613718 | 10/1997 |
| EP | 1868748 | 10/2008 |
| WO | 2007/073841 | 7/2007 |
| WO | 2009/065840 | 5/2009 |

* cited by examiner

*Primary Examiner* — Kevin P Kerns
(74) *Attorney, Agent, or Firm* — Hamre, Schumann, Mueller & Larson, P.C.

(57) ABSTRACT

A rolling method in a rolling line, to obtain strip with a thickness varying from 0.7 mm to 20 mm, for steel which can be cast in the form of thin slabs with a thickness from 30 mm to 140 mm, the line includes a continuous casting device; a tunnel furnace for maintenance/equalization and possible heating; a rolling train having a roughing train and a finishing train; a rapid heating unit, with elements able to be selectively activated, interposed between the roughing train and the finishing train. For each lay-out of the rolling line, the position of the rapid heating unit which defines the number of stands which form the roughing train, disposed upstream of the unit, and the number of stands which form the finishing train, disposed downstream of the unit, is calculated as a function of the product of the thickness and speed of the thin slab.

9 Claims, 11 Drawing Sheets

State of the art

| Process | Coil-to-Coil | Semi-endless | Endless | Universal Endless |
|---|---|---|---|---|
| Strip Thickness: 0.7 to 20.0 mm | NO<br>(1,0 - 20,0 mm) | NO<br>(0,7 - 2,0 mm) | NO<br>(0,7 - 4,0 mm) | **YES**<br>**(0,7 - 20,0 mm)** |
| Suitable for All Casted Steel Grades | YES | YES | NO | **YES** |
| Possible second Casting Line | YES | YES | NO | **YES** |
| Productivity for ultra-thin slabs from 0.7 to 0.9 mm<br>% | N/A | Low<br>60 | High<br>95 | **High**<br>**95** |
| Plant Utilization Factor<br>% | High<br>*85* | High<br>*84* | Low<br>*79* | **High**<br>***85*** |
| Energy Consumption<br>*kWh/ton* | Low<br>*80* | Low<br>*82* | High<br>*140* | **Low**<br>***90*** |
| Yield ( from liquid steel to coil)<br>% | High<br>*97,8* | High<br>*97,7* | Low<br>*96,5* | **High**<br>***97,7*** |

fig. 5

METHOD AND PLANT FOR THE PRODUCTION OF FLAT ROLLED PRODUCTS

FIELD OF THE INVENTION

The present invention concerns a method for the production of flat rolled products, such as strip or plate, and the relative production plant.

BACKGROUND OF THE INVENTION

Rolling plants disposed in a line with a continuous casting machine which produces thin slabs, or "thin slab casters", are known.

Such plants can be planned and configured for a substantially continuous rolling process, or "endless", in which the cast product is rolled in a rolling train which is placed immediately at the exit of the continuous casting machine with which it is in direct contact.

The fact that the rolling train is directly attached at the exit of the continuous casting machine in the endless process allows temperature not to be lost and, moreover, to exploit to the full the heat in the cast product and the low resistance to pressure in the first two-three rolling stands inasmuch as re-crystallization has not yet completely taken place, with consequent saving of energy in the rolling step.

The rolling process of the endless type ensures the possibility of producing ultra-thin strip (for example from 0.7 to 0.9 mm) in that sequences are begun by producing thicknesses from 1.5-3.0 mm then progressively decrease to 0.7-0.9 mm.

Unfortunately the endless process, like the one shown for example in the patent EP 1868748, the layout plan of which is shown in FIG. 1, is very rigid for the reasons given below.

The production of some qualities of steel (for example, peritectic steel, high carbon content steel, silicon steel, API steel) obliges, for metallurgic and qualitative requirements, to lower the maximum speed of continuous casting and, consequently, the mass-flow falls below the minimum value needed to obtain the temperature of at least 850° C. in the last stand of the finishing train, thus rendering endless rolling impracticable for a vast range of thicknesses from 0.7 to 4.0 mm, despite an induction heating located on the train.

Moreover, as the rolling train is located immediately at the exit of the continuous casting machine in the endless process, there is no possibility of having an intermediate buffer between the two rolling and casting processes which are rigidly connected. Therefore each minimum stoppage of the rolling mill and/or the strip winding machines, for example due to a programmed change of the rolling rolls, in order to carry out controls, due to accidents, sudden interruptions or minor breakdowns, requires that the continuous casting process and also that of the steel works upstream is stopped, with a loss in production.

This characteristic of the endless process that it does not have any buffer has the following consequences:

the use factor of the casting-rolling plant, but also that of the steel works upstream, is reduced by 5÷6%;

the yield of the plant (that is the ratio between weight of finished product and weight of liquid steel in the tundish to produce a ton), decreases by 1.2÷1.3% because of the loss of material which is a result of the scrapping of the steel present in the tundish at the exit of the continuous casting machine.

Moreover, the endless process does not allow to insert a second casting line so as to increase the productivity of the plant.

Finally, the endless process has very little flexibility in the production changes (slab width and thickness).

On the contrary, the layout solutions using the thin slab caster of the semi-continuous type provide that the casting machine and the rolling mill are connected in line by a tunnel furnace for heating and/or maintenance which also acts as an accumulation store for the slabs when it is necessary to overcome an interruption of the casting process, because of incidents or because of a programmed roll change, in this way avoiding losses of material and of energy and above all, avoiding an interruption of the casting.

In the case where, in a semi-continuous process where the length of the slab corresponds exactly to the material needed to form a coil of the desired weight, the process is called "coil-to-coil".

In the case where the length corresponds to a multiple of the length needed to form a coil of the desired weight, the so-called super-slab, then the process is called "semi-endless".

We shall now give a summary to clarify the characteristics of the three processes so far considered.

Endless: the process happens in a continuous manner between casting and rolling mill. The cast slab feeds the rolling train directly and continuously. The coils are produced in continuous rolling. The individual coils are formed by means of a cut from the quick shears before the winding reels. There are no entrances in the rolling train.

Semi-endless: the process happens in a discontinuous manner between casting and rolling mill. The super-slab, equivalent to "n" (from 2 to 5) normal slabs, is formed at exit from casting by the cut of the pendulum shears. "N" rolling coils are produced from the relative super-slab at a time. The individual coils are formed by a cut from the quick shears before the winding reels. For every sequence of "n" coils produced there is an entrance in the rolling train.

Coil-to-coil: the process happens in a discontinuous manner between casting and rolling mill. The individual slab is formed at exit from casting by the cut of the pendulum shears. One coil at a time is produced in rolling from the relative starting slab. For every coil produced there is an entrance in the rolling train.

Currently technology provides various solutions, mainly in the bibliography and literature of patents, which have provided various types of plants and processes for rolling flat products, each of which is characterized by one of the modes cited above, that is, "endless", "semi-endless" or "coil-to-coil", which in general are actuated individually or at most only two per plant.

The existing solutions have pros and cons but do not however manage to satisfy to a great extent the needs of a plant which is both flexible and versatile so as to serve the market competitively.

In particular the processes currently existing have the following characteristics which are also summarized in the comparison table shown in FIG. 5:

Endless: optimal for producing ultra-thin thicknesses from 0.7 to 0.9 mm in that it eliminates the entry of the head of the bar in the stands, therefore with lower wear on the rolls and with fewer risks of blockages, it allows a stationary rolling, but on the other hand it cannot produce some types of steel, it has a low use factor of the plant, a low yield and it does not have the possibility of inserting a second line to increase production;

Coil-to-coil: allows to produce the whole range of castable steels with a thin slab caster, it has high use factor of the plant and high yield. On the other hand, it cannot produce thicknesses below 1.0 mm because of the difficulty the strip has in entering the last rolling stands because it is thin and therefore inconsistent.

Semi-endless: is optimal for producing thin thicknesses up to 0.9 mm, it allows to produce the whole range of castable steels with a thin slab caster, it has a high use factor of the plant and high yield. On the other hand, it has a low productivity in the production of ultra-thin strip (0.7-0.9 mm) in that the process necessarily entails that the first and the last coil of the slab are produced with increased thickness; it reduces (by ¼ or ⅓), but does not eliminate the problem of the entrance of the bar into the stands of the rolling train, and finally, it increases the problems of entrance of the strip to the winding reels in that the speeds of advance of the strip are very high compared to the endless mode.

The development of casting technology, particularly by the Applicant, with the introduction, for example, of high-performance crystallizers and sophisticated techniques of dynamic soft reduction, which allow to increase the casting speed and to keep it substantially constant on a wide range of thicknesses, for example from 30 to 140 mm, is beginning to allow to hypothesize new plant and process solutions which considerably increase the flexibility of the plant and to obtain a very high productivity together with a high final quality and to obtain extremely reduced thicknesses.

It is known that the starting cast thickness, given the same casting speed, determines the productivity of the plant, the overall number of rolling stands to be used and, in the case of the "endless" rolling process, the temperature profile from the exit of the continuous casting to the exit of the last finishing stand.

Starting from determinate initial parameters, relating for example to the starting thickness of the cast product, to the final thickness of the rolled product, to the productivity required, the purpose of the present invention is therefore to produce rolling profiles and relative lay-outs of plants capable of producing all the qualities of castable steel with the thin slab technology, together with the available sequences of liquid steel upstream, being able to manage the stopping times of the rolling plant for minor maintenance, roll changes and/or incidents, without ever interrupting the casting process.

The Applicant has devised, developed and tested the present invention to obtain these and other purposes and advantages which will be identified in more detail in the following description.

SUMMARY OF THE INVENTION

The inventive idea is set forth in the independent claims, while the dependent claims describe variants to the inventive idea.

The process according to the invention exploits all the prerogatives of an endless process (the possibility of producing ultra-thin products and energy saving in the rolling step) of which it maintains all the advantages while obviating the limitations, and can thus be defined "endless universal process". In fact the process according to the invention allows:

to produce all the qualities of castable steels with the thin slab technology and hence to cover all the market available;

to have a buffer between the casting machine and the rolling mill that allows to absorb the down times of the rolling mill due to incidents or roll changes, without needing to stop the casting and therefore without losing production and without penalizing the steel works upstream;

to possibly double production by inserting a second casting line.

In particular, the process according to the present invention provides to produce, for all the qualities of steel castable with the thin slab technology with thicknesses comprised between 30 and 140 mm, strip or sheet having a final thickness comprised from 0.7 mm to 20 mm, and is unique in that it incorporates in the same plant the following three operating modes:

a) endless, for final thicknesses of the strip from 0.7 mm to 4.0 mm, for some of said qualities of steel;

b) semi-endless, for final thicknesses of the strip from 0.7 mm to 2.0 mm, for all said qualities of steel;

c) coil-to-coil, for final thicknesses of the strip from 1.0 mm to 20 mm, for all said qualities of steel.

Advantageously, the process provides the possibility of passing automatically from one mode to the other, using the most convenient on each occasion.

The choice of the most suitable operating mode is made considering the entire mix to be produced in the specific rolling campaign (period between 2 rolling roll changes) with the perspective of minimizing production costs, that is, the transformation costs plus the costs deriving from the smaller yield/quality of the finished product.

More particularly, the choice of operating in one of the three operating modes described above is made:

in relation to the quality of steel to be produced;

to obtain different classes of final thicknesses of the strip, optimizing the production process;

to optimize speed, rolling temperatures and relative energy consumption;

to adapt the casting speeds to the available production of liquid steel so as not to interrupt the casting sequences.

According to the invention it is therefore possible to select on each occasion the operating mode that is most suitable to minimize production costs and to optimize energy saving, yield and the use factor of the plant.

Advantageously, the endless mode is used for all qualities of steel that can be cast at high speeds, generally more than 5.5 m/min, for example equal to 6 or 7 m/min.

Such steel are listed below:

IF (Interstitial Free);

ULC (Ultra Low Carbon);

Low Carbon;

Low Carbon HSLA, including API X 50-80;

Medium Carbon (structural);

Medium Carbon HSLA (plates, pipes, shipbuilding, pressure vessels);

High Carbon;

Weather resistant, including those sold under the trademark COR-TEN;

Dual Phase;

and represent about 70% of the whole range of steels castable with the thin slab technology with thicknesses from 30 to 140 mm.

The semi-endless or coil-to-coil mode is used to produce those qualities of steel that have to be cast at speeds of less than 5.5 m/min, for example equal to 4 m/min or lower.

Such steels are listed below:

Peritectic grades (0.08<C %<0.15);

API X 70-80;

Silicon Steel;

High Carbon (C %>0.45%);

and represent about 30% of the whole range of steels castable with the thin slab technology with thicknesses from 30 to 140 mm.

To obtain the above, a plant according to the present invention essentially comprises five main elements, disposed in the sequence indicated below:

a continuous casting device;

a tunnel furnace for possible heating and maintenance/equalization, which connects the continuous casting with the rolling mill;

a roughing train comprising from 1 to 4 rolling stands;

a rapid heating unit with elements able to be selectively activated and removed from the line;

a finishing train comprising from 3 to 7 stands.

In one embodiment, the rapid heating unit consists of one or more inductors.

In one embodiment, the continuous casting device is equipped with a dynamic soft-reduction so as to automatically displace the pressing position of the slab with liquid core in relation to the casting speeds and to the type of material cast.

According to the invention, the ranges of thickness cast and the respective productivity obtainable, identify the following families of processes inside the lay-out of the plant:

cast slab from 30 to 70 mm, productivity from 600,000 to 2,000,000 ton/year;

cast slab from 60 to 100 mm, productivity from 1,000,000 to 2,800,000 ton/year;

cast slab from 80 to 140 mm, productivity from 1,500,000 to 3,500,000 ton/year.

According to a characteristic feature of the present invention, the tunnel furnace for possible heating and maintenance, located between the continuous casting device and the roughing train, has a length such as to contain a quantity, for example expressed in weight, of thin slabs equivalent to from 2 to 5 coils, in order to carry out semi-endless rolling.

Thanks to these sizes of the tunnel furnace for possible heating and maintenance, the plant according to the invention can easily be converted from endless functioning to semi-endless or coil-to-coil functioning, in particular when it is necessary to produce the qualities of steel that cannot be produced in endless mode due to the low casting speeds.

Therefore the tunnel furnace allows to disengage the casting machine from the rolling mill when the quality of the steels cast obliges to reduce the casting speed to values that render the endless process impracticable.

Furthermore, the potential of the tunnel furnace to accommodate up to 5 coils allows to guarantee an accumulation store with which possible stoppages in the rolling process can be managed in coil-to-coil mode, without particular repercussions on casting, which can thus continue to function for a certain time. In this way the productivity of the steel works that feeds the continuous casting machine is optimized.

According to one solution of the invention, the tunnel furnace for possible heating and maintenance is configured to carry out a possible heating step in its first 50-60 m, while in the remaining part it only maintains the temperature reached. In particular, the heating step is provided when the qualities of steel produced require a low casting speed.

According to another solution of the invention, the tunnel furnace for possible heating and maintenance is configured only to maintain the temperature reached. In particular, the maintenance-only step is actuated every time the casting speed is high enough.

According to the present invention, the temperature of the slab exiting from the tunnel furnace is comprised between 1050° C. and 1180° C., which is therefore substantially the temperature at which the slab is sent to the first rolling step in the roughing train.

In one embodiment of the invention, inside the tunnel furnace for possible heating and maintenance, systems are provided for centering and guiding the slab laterally, to be used in particular during the semi-endless and endless modes.

As we said before, the length of the tunnel furnace also determines the buffer time obtainable in coil-to-coil mode during the programmed roll change and/or during the unforeseen stoppages of the rolling mill due to blockages or little incidents.

The duration of the buffer time can be increased by reducing the casting speed, for example by half. Advantageously the buffer capacity of the tunnel furnace allows not to interrupt the casting process during the rolling roll change or during small incidents, and therefore allows not to stop production.

The buffer time therefore increases the use factor of the plant and allows to disengage the casting process from the rolling process for relatively long periods.

Moreover, the buffer time allows to improve the yield of the plant inasmuch as the number of casting restarts is eliminated or at least reduced, with a consequent saving of waste at start and end of casting, and avoids having to scrap the steel that at the moment of the incident is in the tundish at the beginning of the rolling train, as well as that remaining in the ladle which often cannot be recovered.

In one embodiment of the invention, when the segments of slab remain inside the tunnel furnace for possible heating and maintenance for the whole duration of the stoppage of the line, the rolls of the furnace make the slabs move continuously backward and forward by some meters, in order to prevent signs and marks from forming on the contact surface of the slab, giving advantages in the final quality of the product, and so as not to damage the rolls of the furnace.

In another embodiment of the invention, in the terminal part of the tunnel furnace a mobile segment is inserted in order to connect a second casting line, parallel to the first. In this case, both the coil-to-coil mode and the semi-endless mode can be actuated with both lines functioning, whereas the endless mode is performed only with the first line in which all the casting and rolling machines are aligned.

In another variant of the invention, the tunnel is also provided with a system for controlling the traction between casting and the first rolling stand of the roughing train to achieve an optimum management of the endless rolling.

In another embodiment of the invention, the rapid heating unit, for example an inductor with modular elements, can be removed automatically or manually from the rolling line, completely or only partly, for some elements.

The elements of the inductor removed from the line can be replaced by a temperature maintenance tunnel (for example passive insulated hoods equipped with reflecting panels).

No interstand inductors are provided in the finishing train.

According to the invention, the rapid heating unit is configured in its heating and sizing parameters so that the cast slab, in endless or semi-endless mode, arrives at the last rolling stand of the finishing train with a temperature of not less than 830-850° C.

In one formulation of the invention, the heating power delivered by the inductor unit is automatically controlled by a control unit in which a calculus program takes into account the temperatures detected along the rolling mill, the rolling speeds provided, the thickness of the finished product and therefore of the temperature losses expected.

In this way the heating is optimized and a rolling is obtained with a homogeneous temperature right from the first coil.

According to the invention, the positioning of the rapid heating unit, for example the inductor, inside the rolling line, is determined so as to optimize the use of energy for heating the product and taking into account the maximum heating capacity of the specific rapid heating unit.

Therefore, the invention allows to identify the best position of the rapid heating unit inside the rolling train according to the range of thicknesses, starting and final, and to the speed of advance of the strip.

In a preferred solution of the invention, the rapid heating unit is configured to work with a range of product thicknesses comprised between 5 and 25 mm, corresponding to advance speeds of the strip comprised between 20 and 80 m/min.

Thanks to this, a better management is obtained of the rapid heating unit, which is made to work inside an optimum range, and a simplification of the line in that in practice only one interstand rapid heating unit is used, suitably positioned and sized.

The invention provides a method to identify the optimum positioning of the rapid heating unit inside, the rolling train.

Step a)

The maximum possible casting speed and the slab thickness is selected according to the hourly productivity that the casting, and hence the whole plant, must have, and on the quality of steels to be produced. In this way the so-called mass-flow=thickness×speed is defined.

Step b)

The minimum number (Ntot) of overall stands in the rolling train is defined according to the final thickness of the strip to be obtained and the thickness of the slab exiting from casting.

Step c)

The maximum number (Nf_max) of stands that the finishing train can have is determined according to the mass-flow identified in step a). Therefore, by the difference, the minimum number (Ns_min) of stands that the roughing train can have is also defined: Ns_min=Ntot−Nf_max.

Step d)

At this point the total number of stands and the maximum number of stands that the finishing train can have is known.

In the subsequent step the optimum division of the roughing stands and the finishing stands is defined, with the same overall number, and therefore the optimum point where to locate the rapid heating unit.

For example, if the total number of stands defined is 7, we can have the following divisions of the roughing train and the finishing train: 1+6 or 2+5 or 3+4.

To establish the optimum division, we take into account the temperature variation profile at outlet from the tunnel furnace for possible heating and maintenance to the exit from the finishing train, as will be described in detail hereafter with examples.

Step e)

Finally, according to the desired final thickness of the strip and the casting speed as determined in step a), the mode is selected to be used in the rolling process from among the three modes identified above: coil-to-coil, endless, semi-endless.

If the input data in the diagram identify an overlap of the three areas, the criterion for choosing the most suitable mode must also take into account the shortest time required to reach full operating conditions that can be obtained.

In a possible variant of the invention, one of the stands defined for the roughing train is disposed downstream of the casting machine, upstream of the tunnel furnace.

In another possible variant, the first or the last part of the tunnel furnace is replaced by an inductor, so as to shorten the tunnel.

In another variant, the rolling rolls of the train are cooled by an air-mist system, that is, air with nebulized water.

In this case, a system to control the temperature of the rolling rolls is used to adapt the cooling system to the various operating modes.

BRIEF DESCRIPTION OF THE DRAWINGS

These and other characteristics of the present invention will now be described in detail, with reference to some particular forms of actuation, given as a non-restrictive example with the assistance of the attached drawings wherein:

FIGS. 5 to 11 show some diagrams and tables that represent functional relations between parameters of the rolling line and that are used in the method to design the lay-out of the line.

DETAILED DESCRIPTION OF SOME PREFERENTIAL FORMS OF EMBODIMENT

Figure 2:
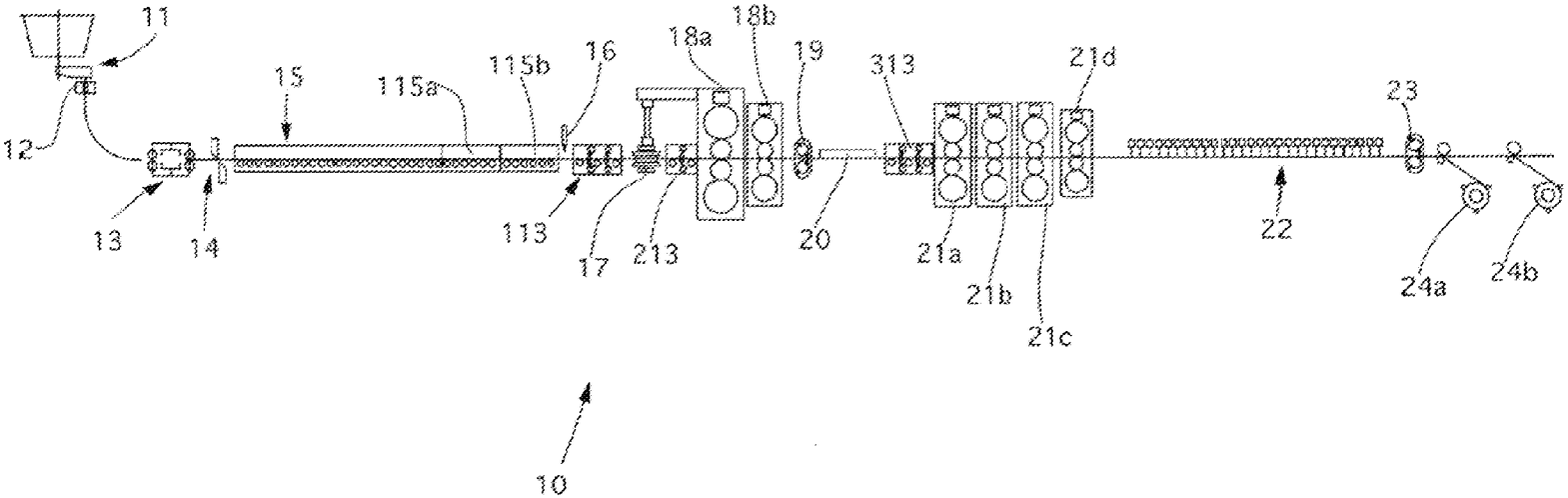
FIGS. 2 to 4 show three different forms of embodiment of lay-outs that implement the method according to the present invention.
Figure 3:
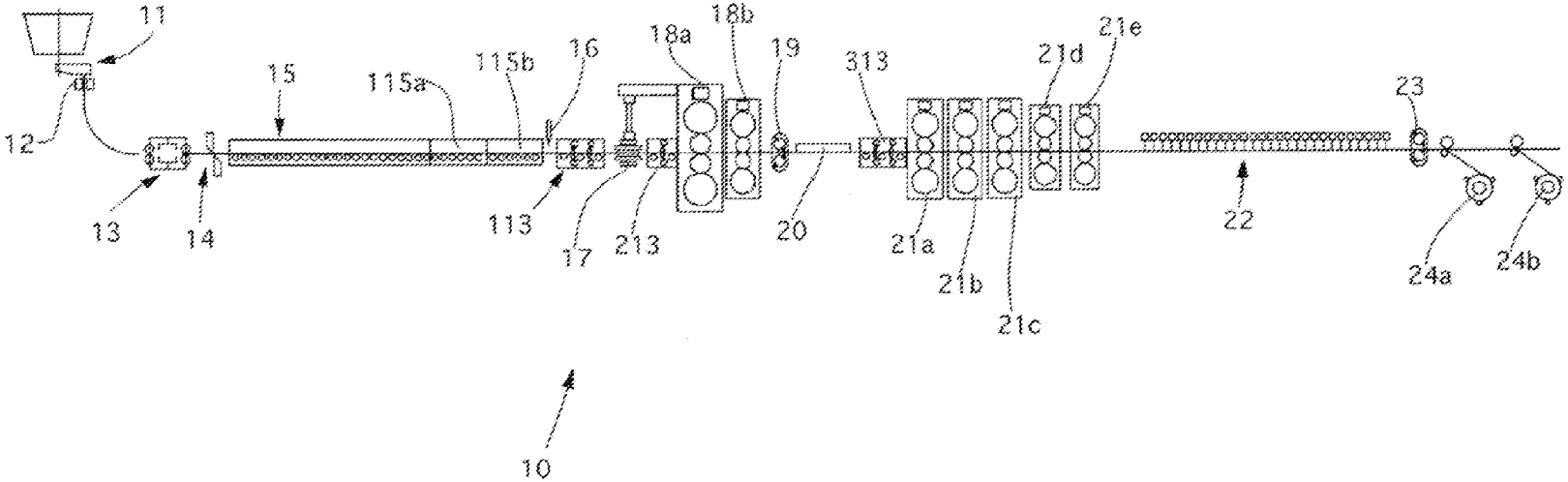
Figure 4:
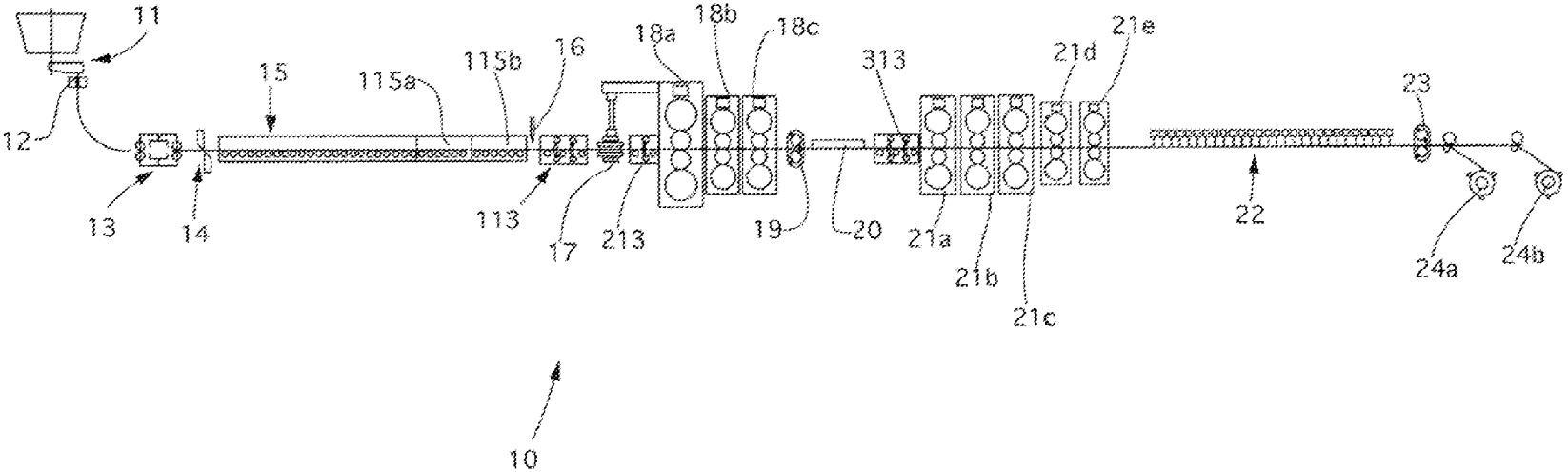

With reference to FIGS. 2-4, three possible lay-outs are shown of a casting/rolling line 10 for flat products that implements the principles of the present invention.

In particular, the lay-out in FIG. 2 is advantageously but not exclusively applied for ranges of thickness of the cast slab from 30 to 70 mm, and productivity from 600,000 to 2,000,000 ton/year.

The lay-out in FIG. 3 is advantageously but not exclusively applied for ranges of thickness of the cast slab from 60 to 100 mm, and productivity from 1,000,000 to 2,800,000 ton/year.

The lay-out in FIG. 4 is advantageously but not exclusively applied for ranges of thickness of the cast slab from 80 to 140 mm, and productivity from 1,500,000 to 3,500,000 ton/year.

In general, the line 10 comprises as constituent elements:

a continuous casting machine 11 having an ingot mold 12;

a first descaling device using water 13;

a pendulum shears 14;

a tunnel furnace 15 having at least the penultimate module 115*a* movable laterally, as described hereafter;

an oxyacetylene cutting device 16;

a second descaling device using water 113;

a vertical or edge-trimmer stand 17 (optional);

a third descaling device using water 213;

a pair of roughing rolling stands 18*a*, 18*b;* a crop shear 19 to crop the head and tail ends of the bars in order to facilitate their entrance and exit to/from the stands of the finishing train; it can also be used in the event of an emergency shearing;

a rapid heating device using induction 20;

a fourth descaling device using water 313;

a finishing rolling train, comprising in this case five stands, respectively 21*a*, 21*b*, 21*c*, 21*d* and 21*e;* laminar cooling showers 22;

a high-speed flying shears 23 to shear the strip to size, to be used in endless or semi-endless rolling, to divide the strip, gripped by the winding reels, into coils of the desired weight; and a pair of winding reels; respectively first 24*a* and second 24*b*.

The ingot mold 12 can be of the through concavity type for thicknesses from 30 mm to 100-110 mm, or of the type with flat and parallel faces for thicknesses from 110 mm to 140 mm.

Immediately downstream of casting there is the pendulum shears 14 for shearing the slabs to length (in coil-to-coil and semi-endless modes) after they have been subjected to descaling by the first descaling device 13.

In particular, in the coil-to-coil functioning mode, the pendulum shears 14 shears segments of slab of a length such as to obtain a coil of a desired weight, for example 25 tons.

On the contrary, in semi-endless functioning mode, the pendulum shears 14 shears segments of slab with lengths from 2 to 5 times that of the coil-to-coil mode.

In the semi-endless functioning mode, in normal working conditions, the pendulum shears 14 does not carry out any shearing on the slab arriving from the casting.

The segments of slab, in semi-endless or coil-to-coil functioning mode, or the continuous slab in endless mode, are introduced inside the tunnel furnace 15 to recover or maintain the temperature.

The penultimate module 115*a* of the tunnel furnace 15 is in this case of the type mobile laterally with the function of a shuttle to allow to use a second casting line, parallel to the first, which shares the same rolling train. The module 115*a* can also serve, possibly, to temporarily accommodate a plurality of segments of slab in a position outside the line, for example in the event of blockages, roll replacement, maintenance, etc.

The last module 115*b* of the tunnel furnace 15 on the contrary can have a parking function, in the event of an interruption to the line for the same reasons as above.

At exit from the tunnel furnace 15 there can be, downstream of the second descaling device 113 and upstream of the roughing train 18*a*, 18*b*, an edge-trimmer stand 17 the function of which is to linearize laterally the conical length of the slab that is generated during the change in width under way in the ingot mold.

The edge-trimming operation improves the quality of the edges of the finished product and increases yield.

Figure 1:
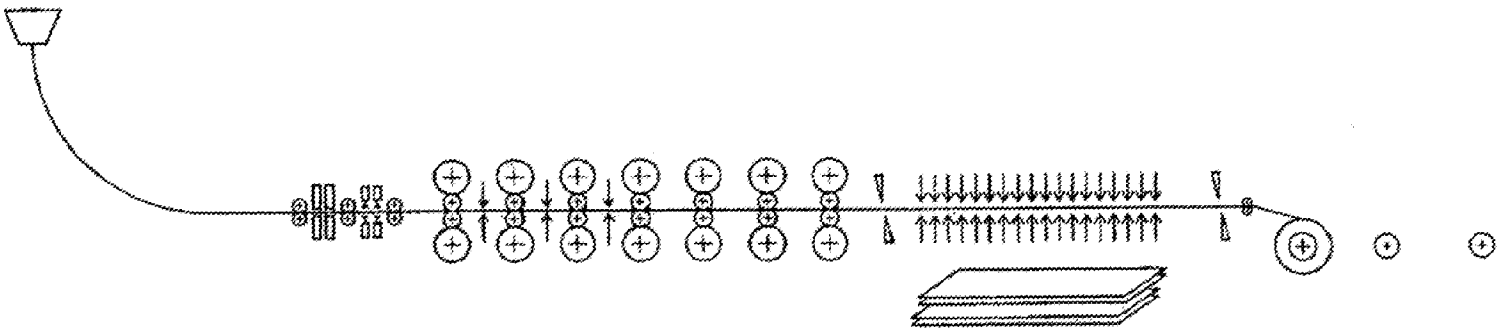
FIG. 1 shows a lay-out of an endless process according to the state of the art.

The rolling train, in the line 10 shown in FIG. 1, comprises two roughing stands, indicated by the numbers 18*a* and 18*b*, and five finishing stands indicated by the numbers 21*a*, 21*b*, 21*c*, 21*d* and 21*e*.

Between the roughing stands and the finishing stands a rapid heating device is interposed, in this case an induction furnace 20, the function of which is to bring the temperature of the slab, according to its starting thickness, final thickness and various other parameters relating to the product, to the most suitable value for rolling.

The inductor furnace 20 can possibly also be removable from the line in the event that, for particular products, its function is not necessary.

Downstream of the inductor furnace 20 there is the fourth descaling device 313, to clean the surface of scale formed during the time the slab is exposed to high temperature air, from exit from the roughing stands 21*a*, 21*b* to the exit from the inductor furnace 20.

After the finishing train showers 22 are provided, to cool the strip before it is wound into coils or reels.

At exit from the showers there is a flying shears 23; in the semi-endless or endless functioning mode, where the strip is simultaneously gripped in the rolling train and in one of the winding reels, the flying shears shear the strip to length so as to obtain the desired final weight of the coil.

In semi-endless mode, in normal working conditions of the plant, at least two steps are provided to cut the product to length:

the first cut is made on the cast slab by the pendulum shears 14;

the second cut is made on the rolled strip by the flying shears 23 before the reels 24*a*, 24*b*.

Like endless mode, semi-endless mode allows to roll thicknesses as thin as 0.9 mm, and even ultra-thin, down to 0.7 mm, although with reduced productivity. Semi-endless mode allows to obtain these thicknesses for all qualities of steel, even for those that entail reducing the casting speed to below 5.5 m/min.

According to the invention, the temperature of the slabs exiting from the tunnel furnace 15 is in the range of 1050° C. to 1180° C.

The inductor furnace 20 is regulated so as to guarantee that the temperature of the strip exiting from the last stand 21*e* of the finishing train is at least equal to 830-850° C.

To this purpose, the system to control the line 10 receives as input at least the main parameters relating to the product to be cast and to the finished product, such as for example thicknesses and speeds, so as to process the temperature profiles along the line 10 of the cast product, in particular at entrance to and exit from the rolling stands, whether they are roughing or finishing stands.

According to the invention, the percentage reduction of the roughing stands are set so that, irrespective of the starting thickness of the slabs, which as we said can vary from 30 to 140, the inlet thickness to the inductor furnace 20 is comprised between 5 and 25 mm, corresponding to speeds of advance of the bar comprised between 20 and 80 m/min.

With this range of thicknesses the functionality of the inductor furnace 20 is optimized, with the best compromise between consumption and heating efficiency.

Starting from this consideration, then the various steps of sizing and design of the line follow.

Figure 6:
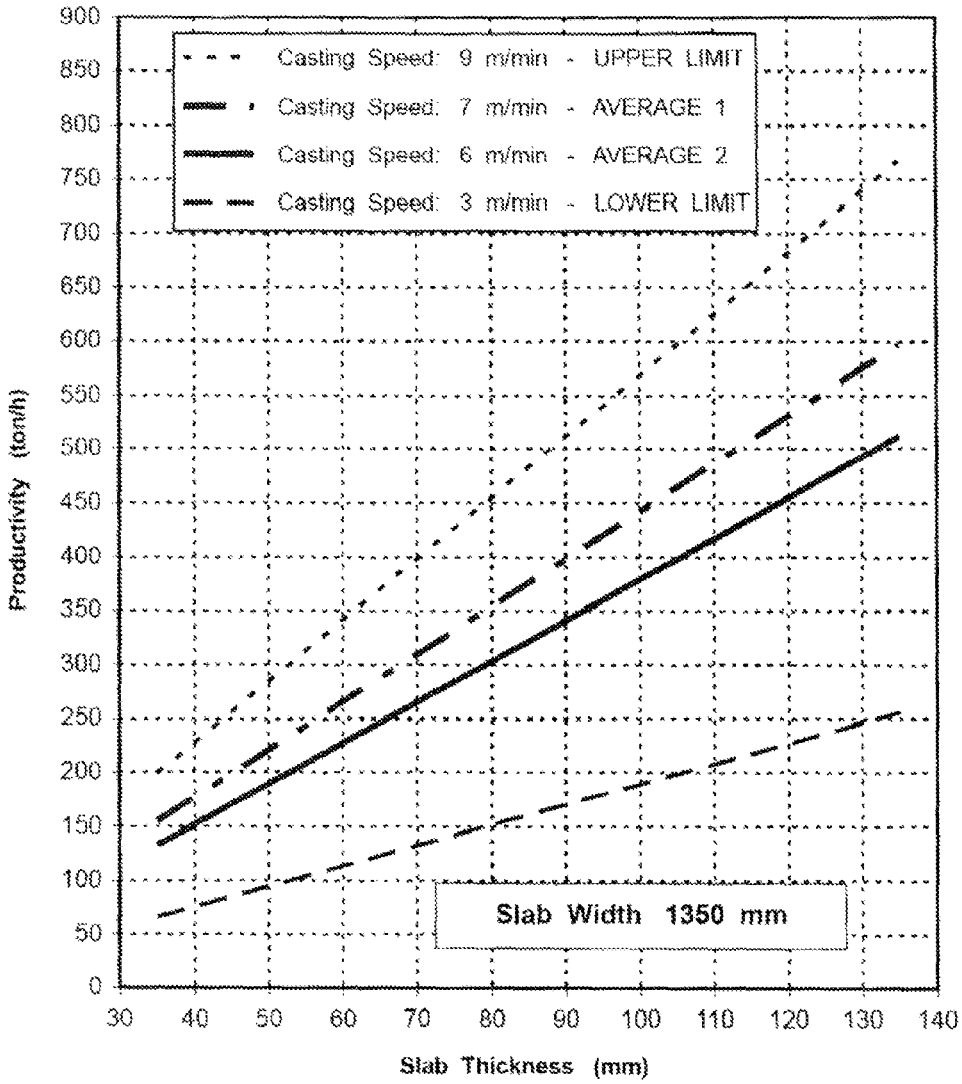
Figure 7:
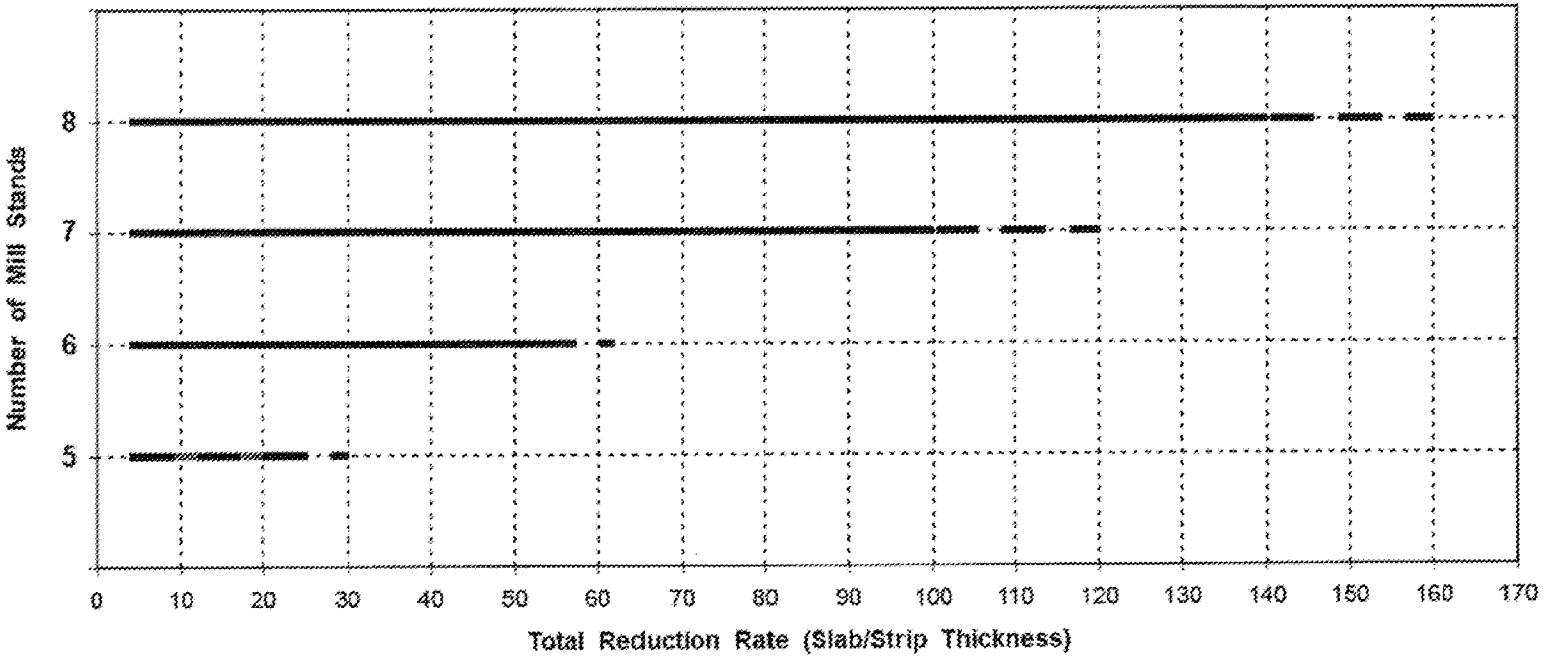

The diagram in FIG. 6, starting from the hourly productivity that casting must have, identifies, according to the maximum possible casting speed for a determinate quality of steel (in this case comprised between the upper limit of 9 m/min and the lower limit of 3 m/min), the thickness that the slab must have, having fixed a determinate width, in this case 1350 mm.

For example, if the hourly productivity must be 500 ton/hour, for an achievable casting speed of 9 m/min, a slab thickness of about 90 mm will be used, for an achievable casting speed of 7 m/min the thickness of the slab will be about 115 mm, for an achievable casting speed of 6 m/min it will be 130 mm, whereas this productivity cannot be obtained with a casting speed of 3 m/min.

Identifying the thickness for a given casting speed determines the value of the so-called mass-flow, which is given precisely by the product of the casting speed and the casting thickness.

Having defined the thickness of the cast product, the next step of sizing the line 10 provides to use the diagram in FIG. 6 to calculate the number of rolling stands to use, said number comprising both the roughing stands and the finishing stands, in relation to the thickness of the final product to be obtained.

As can be seen in FIG. 6, the x axis shows the total reduction value between the slab thickness and the final product thickness, so that in the hypothesis of a reduction of 100% (for example from 80 mm of the slab thickness to 0.8 mm of the final product); the total number of stands is equal to 7, that is, the number of stands in the lines 10 shown in FIGS. 2-4.

Having identified the total number of stands, the next step provides to determine the division of roughing stands, upstream of the inductor furnace 20, and finishing stands, downstream of the inductor furnace 20.

Figure 8:
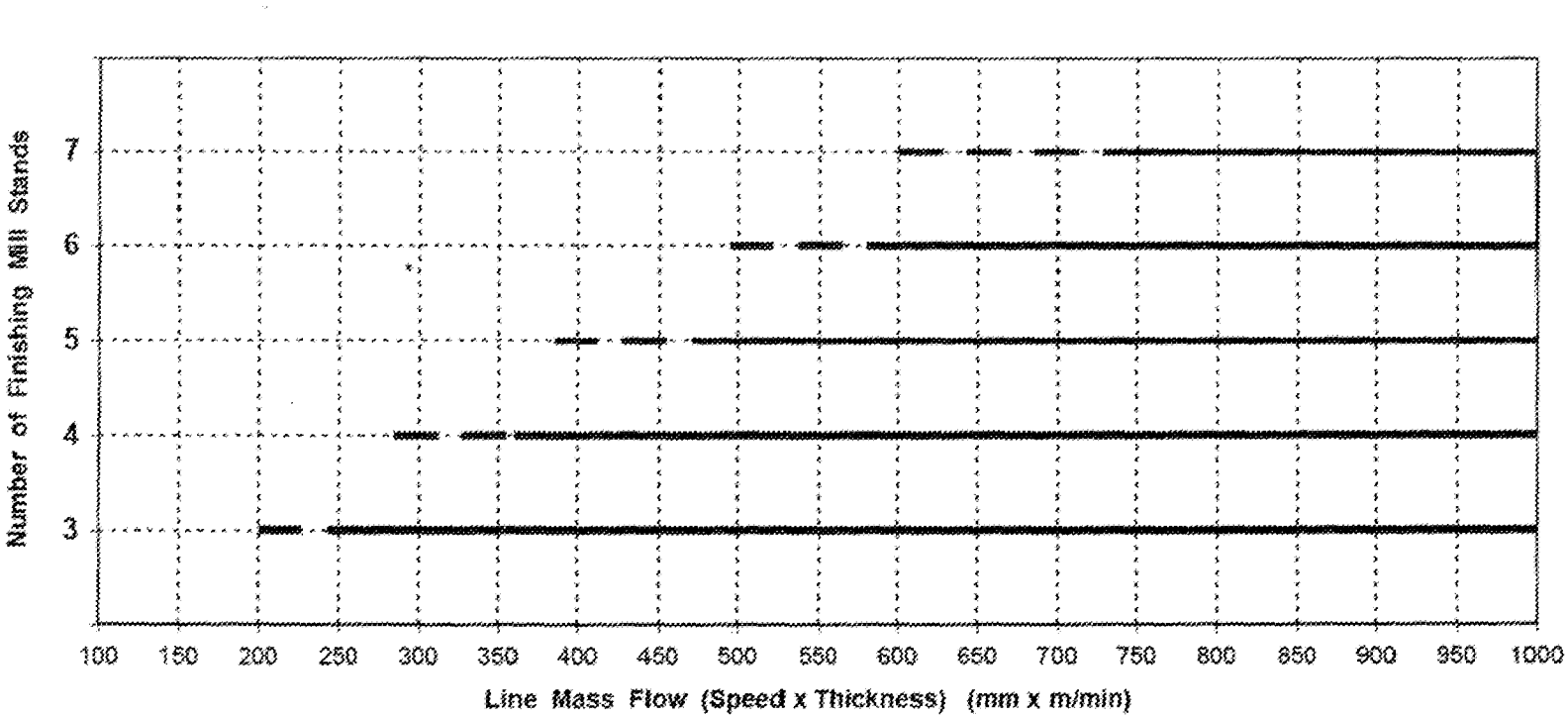

This is obtained by using the diagram in FIG. 8, with which, according to the value of the mass-flow obtained from the diagram in FIG. 5, the number of finishing stands to use is defined and, by difference, the number of roughing stands.

In the example of a casting speed of 8 m/min with a slab thickness of 80 mm, the mass-flow is equal to 640 mm×m/ min, which allows to identify, with the diagram in FIG. 8, the maximum number of finishing stands which the line 10 can have.

The minimum number of roughing stands derives from this maximum number.

Figure 9:
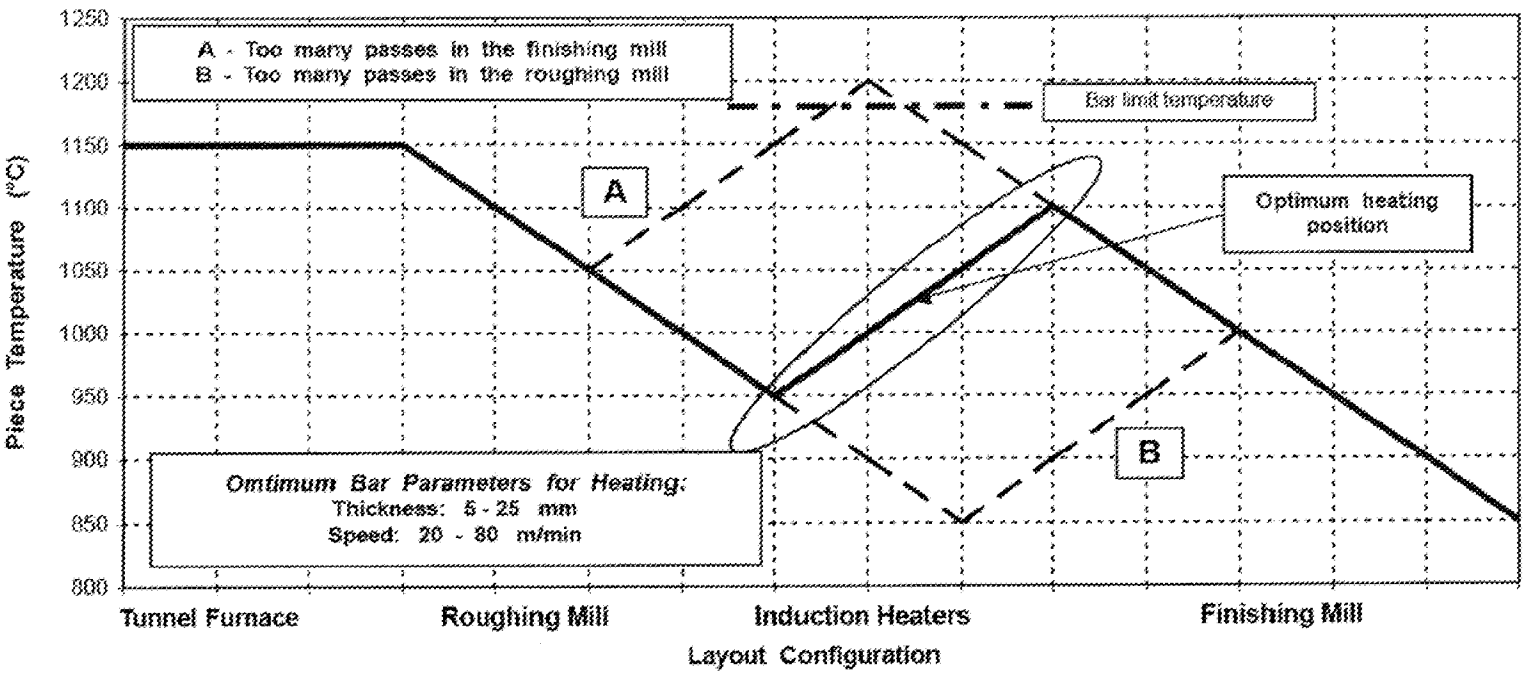

To define the optimum division of finishing stands and roughing stands, and hence the position of the inductor furnace 20; the diagram in FIG. 9 is used, which shows the development of the temperature of the slab from exit from the tunnel furnace 15 to the exit from the last stand (in this case 21*e*) of the finishing train.

Development A, referring to the combination 1+6 (1 roughing stand and 6 finishing stands in the case of 7 stands in all), shows how to reach the last stand of the finishing train with a temperature of at least 850° C. the induction heating performed by the inductor furnace 20 must bring the cast product to a temperature of at least 1200° C.

However, this goes beyond the technical heating possibilities of the inductor furnace 20, and therefore this path is excluded.

Development B, referring to the combination 3+4, might appear to be feasible, but in this case the inductor furnace 20, with three roughing stands located upstream, should manage a thin and quick strip, which makes the inlets very critical.

Therefore, the optimum position is the one between the two, which leads to determine the best division of roughing stands and finishing stands with the formula 2+5.

Figure 10:
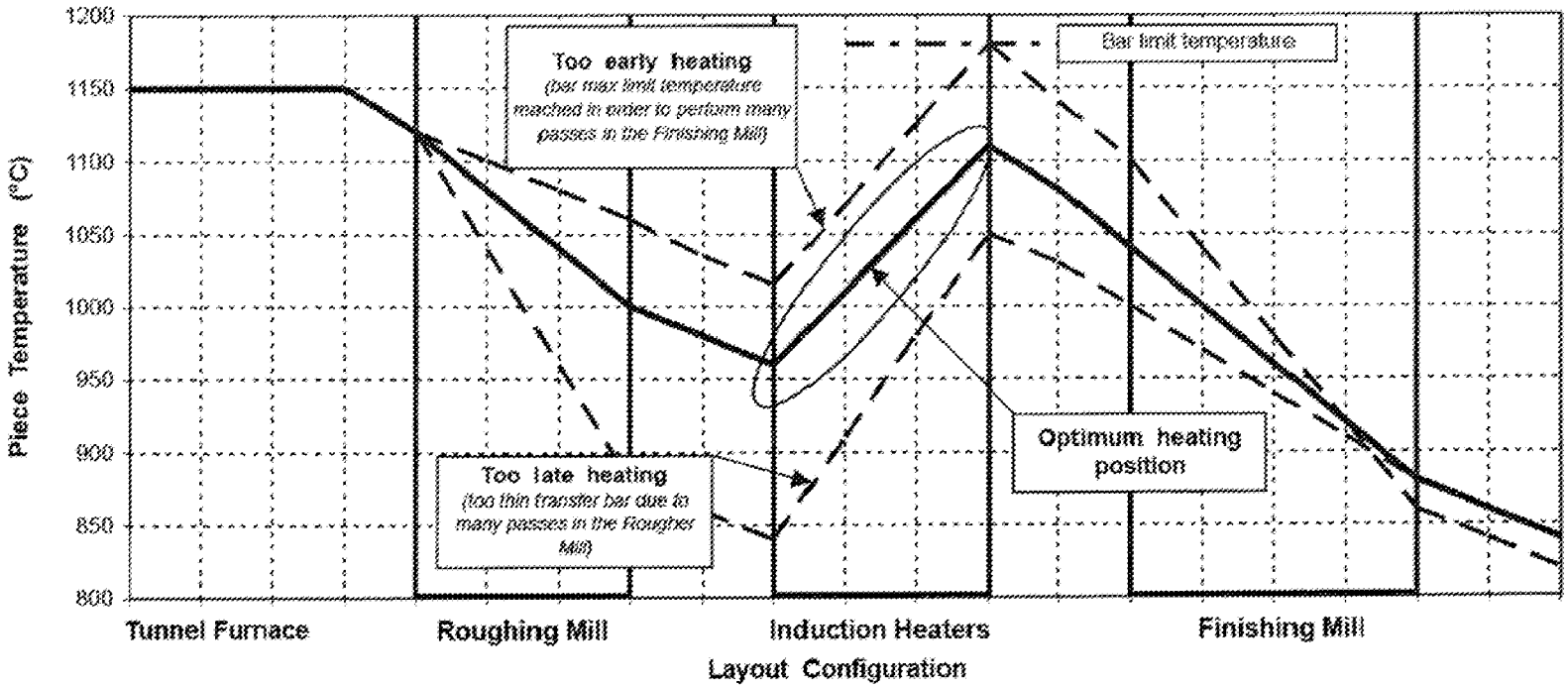

The diagram in FIG. 10 shows the same concept as FIG. 9 in a different form.

In the diagram in FIG. 10, the temperature profiles from the exit from the tunnel furnace 15 to the exit from the last stand of the finishing train are considered, but considering the same groups as unitary blocks, so that the curves indicated join the points that represent the temperatures of inlet and exit from the various blocks.

Finally, after defining the parameters of the line 10 to obtain the desired productivity, after defining the starting thickness, the number of stands, the position of the inductor furnace 20 with respect to the stands, then dividing the part dedicated to roughing from the part dedicated to finishing, the last step provides to choose the mode in which the rolling process will be carried out: endless, semi-endless or coil-to-coil.

Figure 11:
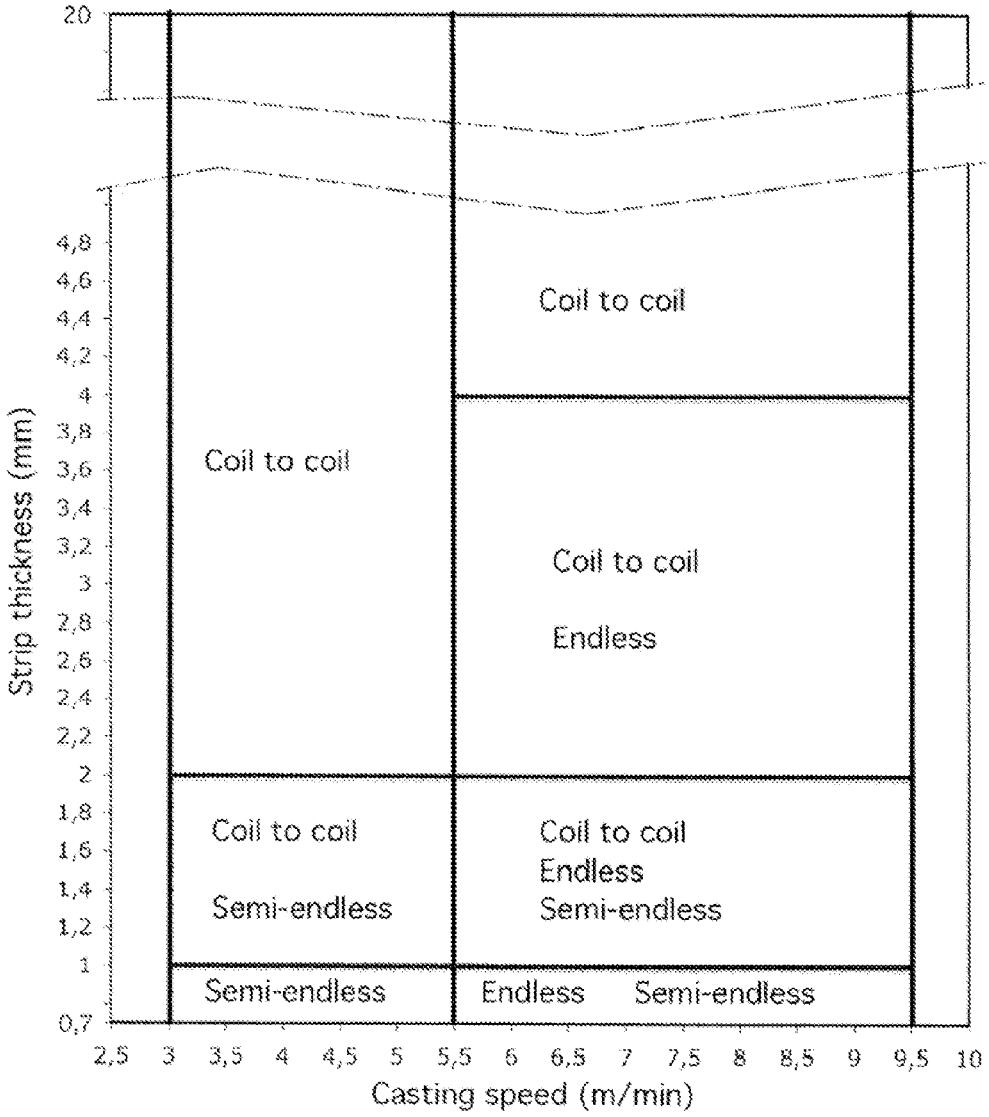

The diagram in FIG. 11 shows how, according to the final strip thickness to be obtained and to the casting speed, it is possible to identify the possible operating modes to execute the process.

The diagram comprises seven quadrants; the x axis indicates the lower limit of the minimum thickness of strip obtainable (0.7 mm) and the vertical line of dashes indicates the lower speed limit to be able to carry out rolling in endless mode. Each quadrant shows the modes that can be achieved. The choice of the most suitable operating mode is made by taking into consideration the whole mix to be produced in the specific rolling campaign (period between 2 roll changes) with the purpose of minimizing production costs, that is, the transformation costs plus the costs deriving from the lesser yield/quality of the final product.

The example described until now is shown in FIG. 3 by a lay-out that provides 2 roughing stands and 5 finishing stands: this lay-out is suitable to obtain a range of productivity comprised between 1,000,000 and 2,800,000 ton/year with a slab thickness varying between 60 and 100 mm.

Other possible configurations are shown in FIG. 2 and FIG. 4.

In particular, FIG. 2 provides 2 roughing stands and 4 finishing stands: this lay-out is suitable to obtain a range of productivity comprised between 600,000 and 2,000,000 ton/year with a slab thickness varying between 35 and 70 mm.

Finally, FIG. 4 provides 3 roughing stands (18*a*, 18*b*, 18*c*) and 5 finishing stands: this lay-out is suitable to obtain a range of productivity comprised between 1,500,000 and 3,500,000 ton/year with a slab thickness varying between 80 and 140 mm.

Therefore, the in-line rolling method according to the invention, called Universal Endless, is unique in that it brings together the three processes—endless, semi-endless and coil-to-coil—in a single plant, in practice eliminating the limitations of the three processes taken individually.

It allows to produce strip with a thickness from 0.7 to 20 mm for all qualities of steel castable in the form of thin slab with thicknesses comprised from 30 mm to 140 mm, with the lowest production cost.

It is clear that modifications and/or additions of parts may be made to the plant and method as described heretofore, without departing from the field and scope of the present invention.

The invention claimed is:

1. A rolling method in a rolling line, comprising:

casting steel in the form of thin slabs with a thickness comprised from 30 mm to 140 mm using the rolling line, wherein the rolling line includes:

a continuous casting device;

a tunnel furnace for maintenance/equalization and possible heating;

a rolling train consisting of a roughing train comprising from 1 to 4 rolling strands and a finishing train comprising from 3 to 7 stands; and a rapid heating unit, with elements able to be selectively activated, interposed between said roughing train and said finishing train;

wherein, for each lay-out of the rolling line, the position of the rapid heating unit which defines the number of stands which form the roughing train, disposed upstream of the unit and the number of stands which form the finishing train, disposed downstream of the unit is calculated as a function of the product of the thickness and speed of the thin slab, said product being in turn a function of the hourly productivity in tons/hour desired to be obtained, wherein the rolling line is made to work either in coil-to-coil mode, or in semi-endless mode or in endless mode, and wherein one of the three aforesaid modes of the rolling process is selected according to the quality of the steel produced, to the maximum casting speed possible for said quality of steel, to the final thickness of the strip and to the production cost, the tunnel furnace, located between the continuous casting device and the first stand of the roughing train, has a length such as to contain a quantity, expressed in weight, of thin slabs equivalent from 2 to 5 coils, and the tunnel furnace has a mobile segment to connect a second casting line, parallel to the first; and obtaining from the rolling line, strip of steel with a thickness varying from 0.7 mm to 20 mm.

2. The rolling method as in claim 1, further comprising:

determining said position of the rapid heating unit with the following steps:

a) selecting the maximum casting speed possible and thickness of the slab, as a function of the hourly productivity required and the quality of the steels to be produced, to define the mass-flow=thickness×speed;

b) determining a minimum number of overall stands of the rolling train as a function of the final strip thickness desired to be obtained and the thickness of the slab exiting from casting;

c) as a function of the mass-flow identified in step a), determining the maximum number of stands for the finishing train, thus determining, by difference, the minimum number of stands that the roughing train must have; and d) determining a division between the roughing stands and the finishing stands, given the same overall number, and therefore of the optimum point in which to position the rapid heating unit, in consideration of the temperature variation profile from the exit of the heating and maintenance tunnel furnace to the exit of the finishing train.

3. The rolling method as in claim 1, further comprising:

configuring the rapid heating unit to work with a range of product thickness comprised between 5 and 25 mm, corresponding to strip feed speeds comprised between 20 and 80 m/min.

4. A rolling plant to obtain strip with a thickness varying from 0.7 mm to 20 mm, for all qualities of steel which can be cast in the form of thin slabs with a thickness comprised from 30 mm to 140 mm, comprising:

a continuous casting device;

a tunnel furnace for heating and maintenance/equalization;

a rolling train consisting of a roughing train comprising from 1 to 4 rolling stands and a finishing train comprising 3 to 7 stands;

a rapid heating unit, with elements able to be selectively activated, interposed between said roughing train and said finishing train;

wherein the rolling plant further comprises, for each layout of the rolling line, a number of roughing stands disposed upstream of the rapid heating unit, and a number of finishing stands disposed downstream of the rapid heating unit, which is a function of the product of the thickness and speed of the thin slab, said product being in turn a function of the hourly productivity in tons/hour desired to be obtained, wherein the rolling line is made to work either in coil-to-coil mode, or in semi-endless or in endless mode, and wherein one of the three aforesaid modes of the rolling process is selected according to the quality of the steel produced, to the maximum casting speed possible for said quality of steel, to the final thickness of the strip and to the production cost, the tunnel furnace, located between the continuous casting device and the first stand of the roughing train, has a length such as to contain a quantity, expressed in weight, of thin slabs equivalent from 2 to 5 coils, and the tunnel furnace has a mobile segment to connect a second casting line, parallel to the first.

5. The rolling plant as in claim 4, wherein the rapid heating unit is configured in the parameters regarding position between the rolling stands, heating and sizing in such a manner that the slab cast, in endless or semi-endless mode, arrives at the last rolling strand of the finishing train with a temperature of not less than 830-850° C.

6. The rolling plant as in claim 4, wherein the rapid heating unit consists of one or more inductors.

7. The rolling plant as in claim 4, configured to operate with slab thicknesses from 30 to 70 mm, to obtain productivity from 600,000 to 2,000,000 tons/year;

from 60 to 100 mm to obtain productivity from 1,000,000 to 2,800,000 tons/year; and from 80 to 140 mm, to obtain productivity from 1,500,000 to 3,500,000 tons/year.

8. The rolling plant as in claim 4, wherein the heating and maintenance tunnel furnace has rolls that, when the segments of slab remain inside the heating and maintenance tunnel furnace, and for the whole duration of their stoppage therein, move the slabs backward and forward, in order to prevent signs and marks from forming on the contact surface of the slab.

9. The rolling plant as in claim 4, wherein the inductor furnace is configured to work with a range of product thicknesses comprised between 5 and 25 mm, corresponding to strip feed speeds comprised between 20 and 80 m/min.

* * * * *